United States Patent [19]

DeLee

[11] 4,115,966

[45] Sep. 26, 1978

[54] CLAMPING DEVICE FOR DISPLAY STRUCTURES

[76] Inventor: Barry DeLee, 2650 N. Lakeview, Chicago, Ill. 60614

[21] Appl. No.: 768,364

[22] Filed: Feb. 14, 1977

[51] Int. Cl.[2] ..... G09F 7/18; E04H 12/20

[52] U.S. Cl. ..... 52/148; 52/38; 52/40; 52/474; 248/229; 40/607; 403/385

[58] Field of Search ..... 52/27, 40, 38, 397, 52/146; 248/229, 540, 541; 40/145 R; 403/385, 386, 73, 188

[56] References Cited

U.S. PATENT DOCUMENTS

| | | | |
|---|---|---|---|
| 1,776,231 | 9/1930 | Dreher | 52/495 |
| 1,803,508 | 5/1931 | Rossman | 248/229 |
| 2,686,029 | 8/1954 | Raymond | 248/229 |
| 2,705,603 | 4/1955 | Bitz | 248/541 |
| 3,237,899 | 3/1966 | Lewis | 248/229 |

*Primary Examiner*—John E. Murtagh
*Attorney, Agent, or Firm*—Wallenstein, Spangenberg, Hattis & Strampel

[57] ABSTRACT

A clamping device is provided from which various structural systems can be built comprising poles or tubular members, panels or a combination of the same. The clamping device comprises a pair of socket-forming assemblies hinged for pivotal movement preferably about a common hinge axis which enables the socket axes to be progressively varied between positions where they are parallel to a selection of positions where they are perpendicular to one another. Means are provided for selectively locking the socket-forming assemblies in any one of their adjusted positions. Each of the socket-forming assemblies comprises a pair of confronting members having confronting surfaces forming a socket for receiving a panel or rubber-like insert member having a slot adapted to receive a panel therein. The socket-forming surfaces of each pair of confronting members terminate to form an entryway into the socket of appreciable size and preferably asymmetrically related to a line at right angles to the hinge axis. Each such pair of members is reversible in position in the clamping structure so that the socket entryway of the two socket-forming assemblies can be asymmetrically related on either side of said line to maximize the angular extent over which the insert slots open onto the socket entryways.

13 Claims, 10 Drawing Figures

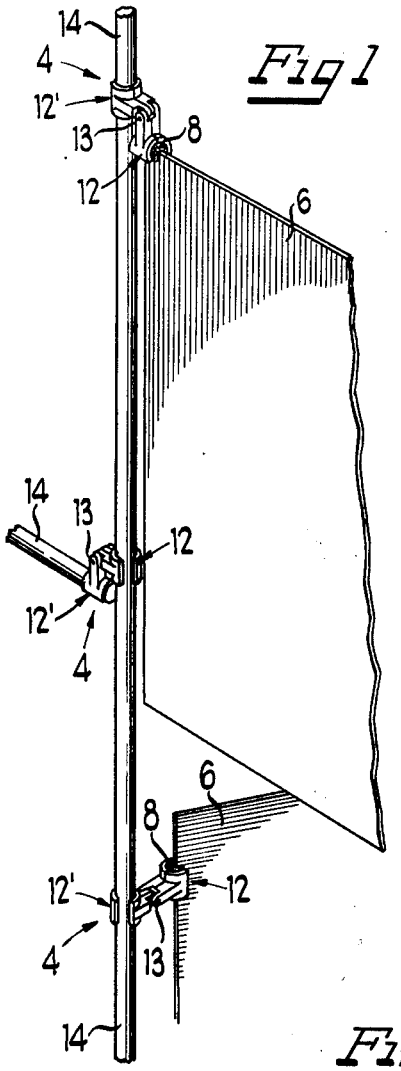
Fig 1
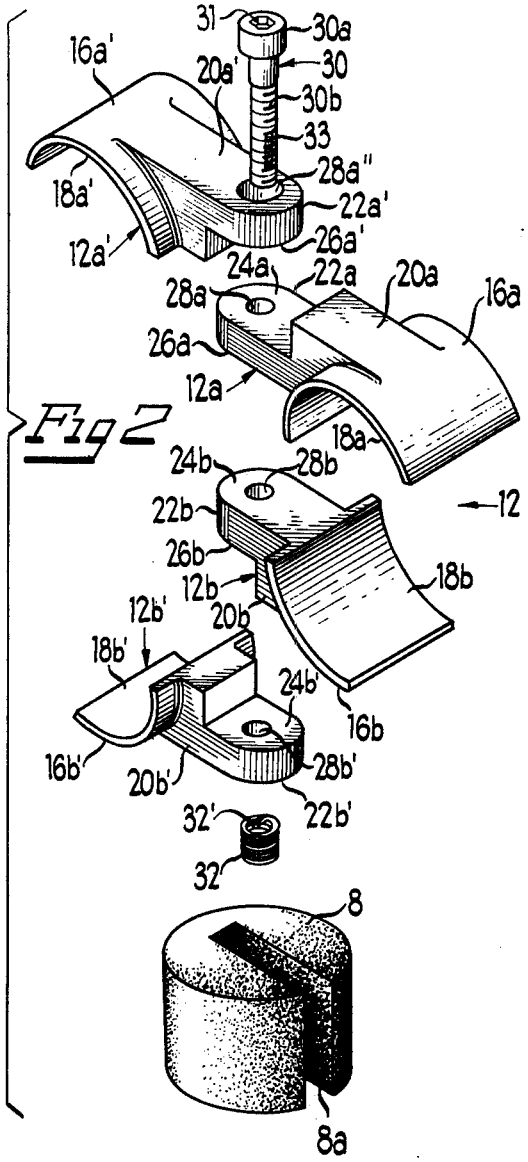
Fig 2
Fig 1A
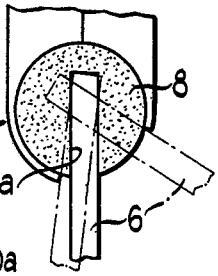
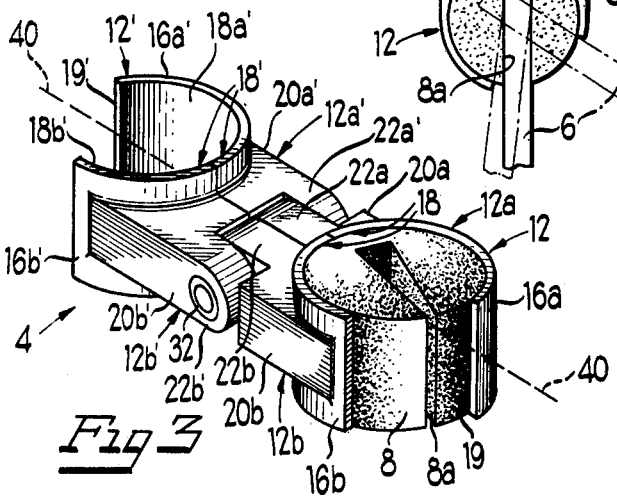
Fig 3
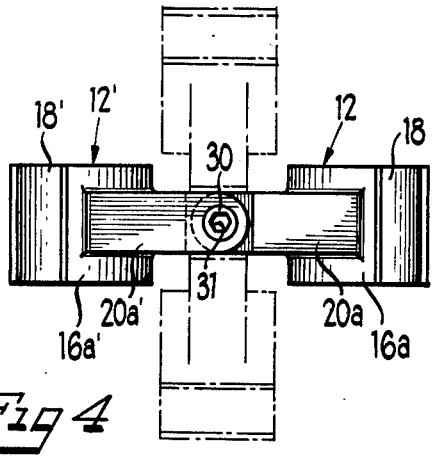
Fig 4

CLAMPING DEVICE FOR DISPLAY STRUCTURES

BACKGROUND OF INVENTION

Readily demountable display structures are in common use for displaying various objects at travelling exhibitions, trade shows, fairs and the like. The particular form of these display structures varies with the objects to be exhibited and the nature of the display facilities involved. These display structures are sometimes self-supporting and sometimes are supported from either or both the ceiling and walls of the display room involved. Thus, the display structures may comprise panels attached to tubular members or poles, which can form a self-supporting structure or can be suspended from the ceiling or connected to walls by fastening cables or other structural members. The various panel, pole, tube, cable or other structural elements are interconnected in various ways. One particularly useful device heretofore used to interconnect adjacent poles, tubes or panels is a two piece aluminum clamp with associated clamping bolt and nut and two slotted rubber insert members. The insert members are cylindrical and fit into a pair of corresponding parallel cylindrical sockets formed between the two confronting aluminum pieces into which the clamping bolt passes. The sockets, which are fixed in position relative to one another, are open on their outwardly forming sides to form socket entryways extending over an arc of roughly 90°. The insert members, which are clamped in the sockets, have panel edge-receiving slots. The clamping device has a mirror-image symmetry on opposite sides of a plane extending through the clamping bolt axis and the socket entryways open onto the right and left lower quadrants of the sockets. When clamping pressure is released, the insert members in the sockets can be rotated into positions in the sockets so that the slots thereof open onto the entryways of the associated sockets over a range of angles corresponding roughly to the arcuate extents of the socket entryways, so that the number of structural orientation possible with this clamping device are limited accordingly.

Any sized panels may be used with this clamping device as long as the thickness of the panels match the size of the slots in the insert members. Glass panels as well as panels made of other materials can be interconnected by these clamping devices without special fasteners or slotted tracks. While poles may be used in conjunction with a panel extending in a plane including the axis of the pole or tubular member by removing an insert member from a socket and passing the pole or tubular member into the socket, such a use is very limited because the sockets of each clamping device are always parallel, and many display structures used with poles or tubular members extend in planes making an angle with each other or with an adjacent panel.

Thus, this prior clamping device described, which defines both sockets thereof between the same two confronting pieces, is useful primarily in building display structures comprising primarily a series of vertically oriented interconnected panels, and cannot, without the use of other types of fastener devices, interconnect a vertical panel and an elongated structural member like a pole or tubular member extending at right angles to the same, and so the variety of display structures which can be built using only these clamping devices having parallel sockets is greatly limited.

It is, therefore, an object of the present invention to provide a clamping device having the advantages of the clamping device just described, but without the limitations thereof, so that display structures having panels and/or elongated members of all types and orientations can be constructed therewith without the need for other kinds of fastener devices.

SUMMARY OF THE INVENTION

The clamping device of the present invention includes the desireable features of the clamping device above described, namely a pair of sockets each defined between a pair of confronting members which can be drawn toward one another to clamp panels, poles, tubular members or the like within the sockets. Where a pair of panels are to be interconnected thereby, each socket receives a resilient compressible rubber-like insert member having a panel edge-receiving slot which can open upon the entryway of the socket at a number of different angular positions thereof so that a panel can enter the slotted insert at selected angles, permitting adjustment of the angles between the panels interconnected by the clamping device. The clamping device is locked in place to clamp tightly around the insert members by tightening a screw or bolt interconnecting the confronting socket forming members. (A clamping device having these features is disclosed in U.S. Pat. No. 3,158,961, granted Dec. 1, 1964, but this clamping device has the same limitations as the prior clamping device above described.)

The present invention makes a substantial improvement over the prior clamping devices having the desireable features just described, by constructing the socket-forming members of the device from four rather than two pieces so that each socket is defined between a different pair of confronting members separately pivotable about a given pivot axis, so that the longitudinal axes of the sockets formed by these two pairs of confronting members can be adjusted to various positions between those where the socket axes are parallel and to those where they are generally perpendicular to one another. The largest variation in the positions of the insert member slots is achieved by designing each pair of confronting members to locate the socket entryways in quadrants which are located generally on one side or the other of a line transverse to the pivot axis thereof, so that a reversal of each pair of confronting members places the entryway on the opposite side of this reference line.

In accordance with another feature of the present invention, to reduce the complexity and number of parts making up the clamping device, the socket-forming assemblies formed by separately adjustable pairs of confronting members are hinged for pivotal movement about a common hinge axis. Accordingly, the two pairs of confronting members have pivot-forming portions in axial alignment with one another. These aligned portions preferably form sleeves with aligned apertures which receive a hinge-forming member. These aligned portions of the socket-forming members form a sandwich of such portions wherein a clamping force applied to the outermost of these portions simultaneously clamp the two pairs of confronting socket-forming members around the elongated members or compressible insert members in the sockets thereof.

In accordance with another aspect of the present invention, the aforementioned hinged-forming member is most advantageously in the form of a self-locking screw having a head portion bearing on a shoulder on one of the outermost aligned portions of the confronting members, and a threaded shank portion passing through the intermediate aligned portions thereof and making threaded engagement with the other outermost portion thereof. When the screw is not fully tightened, it acts as a hinge pin, permitting the pairs of confronting members to be adjusted to any desired angular position, and when it is tightened, the entire sandwich of confronting members is clamped tightly around the elongated members and/or insert members in the sockets thereof.

Since the panels or elongated members extending into the sockets of the clamping device of the invention can have a wide variety of angular relationships, display structures of a wide variety of types and configurations can be built with a number of identical clamping devices of the invention interconnecting panels and/or elongated structural members.

The above and other features and advantages of the invention will become apparent upon making reference to the specification to follow, the claims, and the drawings.

DESCRIPTION OF DRAWINGS

FIG. 1 is a perspective view of a portion of a display structure comprised of tubular members or poles and panels extending at various angles into the sockets of the clamping devices of the present invention;

FIG. 1A is an enlarged vertical sectional view through the vertically extending section of one of the clamping devices of FIG. 1, and illustrates how the panel shown can be adjusted from a vertical tilted position;

FIG. 2 is an exploded view of the basic elements making up a clamping device of the present invention;

FIG. 3 is a perspective view of the parts shown in FIG. 2 assembled into a clamping device;

FIG. 4 shows the extremes of adjustment of the two socket-forming sections or assemblies of the clamping device of FIGS. 2 and 3;

DESCRIPTION OF EXEMPLARY EMBODIMENTS OF THE INVENTION

Figure 5:
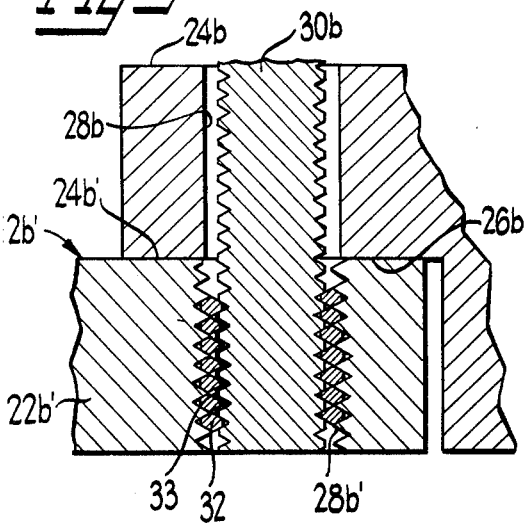
FIG. 5 is a fragmentary greatly enlarged vertical sectional view through the clamping screw-receiving part of the clamping device of FIG. 3.

Refer now to FIG. 1 which shows a unique display structure formed when clamping devices 4 of the present invention are combined with panels 6 and poles or tubular members 14. The uppermost clamping device 4 interconnects and clamps the upper edge portion of a panel 6 and a pole or tubular member 14. In a manner to be described, the clamping device thereshown has a downwardly extending socket-forming section 12 defining a horizontally extending socket holding a cylindrical compressible insert member 8 having a slot **8*a* into which the edge portion of a panel 6 extends through a downwardly facing socket entryway to be described, and a horizontally extending socket-forming section 12' which forms a vertically extending socket into which a vertical pole or tubular member 14 extends as shown in FIG. 1. By rotating the insert member 8 so that the slot 8*a* tilts with respect to a vertical plane, the panel 6** can be similarly oriented.

In a manner to be described, the socket-forming sections 12 and 12' are pivotable about a common hinge at 13 so that the sections 12 and 12' may have any one of a number of different angular positions between one where they extend in the same plane, as in the case of the bottommost clamping device 4 in FIG. 1, and one where they extend at right angles to one another, as in the case of the intermediate and uppermost clamping devices 4 in FIG. 1.

The lowermost clamping device 4 shown interconnecting a panel 6 with a bottom portion of the pole 14 has socket-forming sections 12 and 12' extending horizontally between the panel 6 and the pole 14, thereby spacing the panel 6 a greater distance from the pole 14 than does the uppermost clamping device.

The intermediate clamping device in FIG. 1 interconnects the vertical pole 14 with another pole 14 extending at right angles to the former pole. In a manner to be described, by varying the angle between the socket-forming sections 12 and 12', the clamping device 4 and the pole 14 can be interconnected at any desired angle between one where the poles are parallel to one where the poles are at right angles, as shown.

Perhaps as best shown in the exploded view of FIG. 2 and in FIG. 3 showing the assembly of the parts shown in FIG. 2, the socket-forming sections 12 and 12' of the clamping device 4 are formed by pairs of confronting members **12*a*–12*b* and 12*a'*–12*b'*. The members 12*a* and 12*a'* have head portions 16*a* and 16*a'* of asymmetrical shape providing cylindrical socket-forming surfaces 18*a* and 18*a'* extending over an arc preferably much greater than 90°, as for example, about 165°. The members 12*b* and 12*b'* which confront the members 12*a* and 12*a'* have head portions 16*b* and 16*b'* of asymmetrical shape providing cylindrical socket-forming surfaces 18*b* and 18*b'* which, for example, extend over an arc preferably slightly greater than 90°, such as 105°, to define with the surfaces 18*a* and 18*a'* respective sockets 18 and 18' together extending over much less than 360°, for example, 270°, to leave socket entryways 19 and 19' of about 90° wide, facing in opposite direction generally outwardly of the clamping device when the socket-forming sections are in their coplanar positions shown in FIG. 3. Also, as shown in FIG. 3, the socket entryways are unsymmetrically related to a reference line extending between the centers of the sockets 18 and 18'. In FIG. 3 the socket 18 contains a compressible panel edge-receiving insert member 8 and the other socket 18' is left fully open to receive a pole 14** or other elongated member.

The socket-forming head portions **16*a* and 16*a'* of the members 12*a* and 12*a'* respectively extend from relatively thick neck portions 20*a* and 20*a'* which terminate in relatively thin interleaving sleeve portions 22*a* and 22*a'*** which are half the thickness of the neck portions 20*a* and 20*a*'. The sleeve portion 22*a*' is positioned outside of the sleeve portion 22*a* and these sleeve portions have unthreaded pivot bearing-forming apertures 28*a* and 28*a*' which are in alignment. Similarly, the members 12*b* and 12*b*' have relatively thick neck portions 20*b* and 20*b*' located between the associated socket-forming head portions 16*b* and 16*b*' and aligned interleaving sleeve portions 22*b* and 22*b*' of half the thickness of the neck portions 20*b* and 20*b*'. The sleeve portion 22*b*' is located outside of the sleeve portion 22*b* and both of these portions have aligned apertures 28*b*' and 28*b*. The confronting sleeve portions 22*a*, 22*a*', 22*b* and 22*b*' form a sandwiched assembly which can be clamped tightly together into their adjusted positions by a drawing force applied between the outermost sleeve portions 22*a*' and 22*b*'. The sleeve portions 22*a*', 22*a*, 22*b* and 22*b*' have parallel flat abutting surfaces 26*a*'–24*a*, 26*a*–24*b* and 26*b*–24*b*'.

The aligned apertures 28*a*, 28*a*', 28*b* and 28*b*' of the various sleeve portions 22*a*', 22*a*, 22*b* and 22*b*' receive a common pivot-forming and clamping member which, in the preferred form of the invention, is in the form of a screw 30. The screw 30 has a head 30*a* with a hexagonal wrench-receiving socket 31. The screw fits into a counterbore 28*a*'' in the outermost sleeve portion 22*a*'. The screw 30 has a threaded shank portion 30*b*, the peripheral portions of which form pivoting surfaces for the smooth surfaces of the sleeve apertures 28*a*, 28*a*' and 28*b*. The aperture 28*b*' of the sleeve portion 22*b*' however, is threaded. When the member 12*b*' containing the aperture 28*b*' is made of a relatively soft material like aluminum, the aperture 28*b*' preferably has a screw thread insert 32 manufactured by the Heli-coil Products Division of the Mite Corporation of Danberry, Conn. This insert member is a coil of steel which initially includes a transverse tool-receiving tang 32' at one end thereof. A special tool (not shown) is inserted through the other open end of the screw thread insert 32 and pushed into a position where a slot in this tool engages with the tang 32'. The outside diameter of the insert 32 is initially somewhat greater than the size of the aperture 28*b*'. The tang end of the screw thread insert is then inserted into one end of the aperture 28*b*' by rotating the tool so the coil forming the insert contracts, to permit the same to enter the threads of the aperture 28*b*'. In this manner, the screw thread insert is positioned within the aperture 28*b*', and when the rotational force thereon is relieved, the thread insert expands into tight frictional engagement with the walls of the aperture 28*b*'. The tang 32', which is connected to the rest of the insert by a thin section of material, is then punched or otherwise removed from the insert.

The screw 30 illustrated is a special self-locking screw manufactured and sold by the Precision Fastener Division of Standard Press Steel Company of Jenkintown, Pa. This screw has applied to a portion of its thread a narrow vertical segment 33 (FIGS. 2 and 5) of a synthetic plastic material applied to the threads of the screw. This plastic material enlarges the thread size to form a compression fastener with a clamping force that is concentrated at this point. When the screw is tightened so the various sleeve portions of the members 12*a*', 12*a*, 12*b*' and 12*b* are tightly clamped together, the segment 33 of plastic material forms a locking element which holds the assembled parts tightly together, and provides a locking action which keeps the screw from loosening. The clamping action creates friction between the locking segment 33 and the thread of the screw thread insert 32. However, this locking segment does not hinder movement of the screw 30 when it is not fully tightened.

Figure 6:
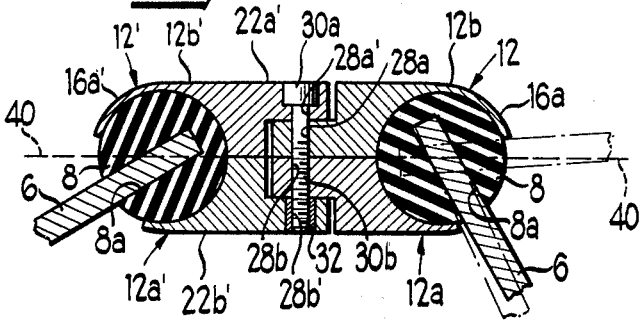
FIG. 6 is a vertical sectional view through the clamping device shown in FIG. 3, where compressible panel edge-receiving insert members have been placed within both of the sockets of the device, and the edges of a pair of panels extend into the slots of the insert members.
Figure 7:
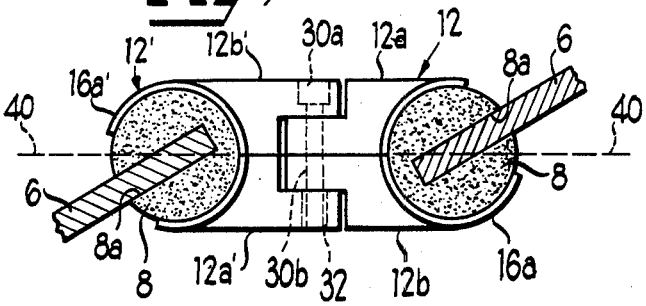
FIG. 7 shows the clamping device of FIG. 6 when the confronting members making up the right hand section of the device are reversed in position, so that the panels can be supported at relative angles which are not possible with the arrangement of the clamping device shown in FIG. 6.

For a better understanding on some of the applications of the clamping device 4, reference should now be made more particularly to FIG. 6, which shows the clamping device interconnecting two panels 6—6 extending vertically at an angle of 45° with respect to one another. In this form of the invention, each of the sockets 18 and 18' contains a compressible panel edge-receiving insert member 8. The orientation of the slots 8*a*—8*a* in the panel edge-receiving insert 8 members in the sockets 18 and 18' were oriented as shown by the loosening of the screw 30 and the rotation of the insert members so that the positions of the slots 8*a*—8*a* thereof extended at a 45° angle with respect to the longitudinal axis of the screw 30 with the socket-forming sections 12 and 12' of the clamping device in their coplanar positions. Retightening of the screw 30 locked the parts of the clamping device in their adjusted positions. It can be seen from FIG. 6 that each of the panels 6 in FIG. 6 can be adjusted in position by an adjusting procedure just described over an angle slightly less than 90° (even though the socket entryways are shown extending exactly 90°) in a quadrant below the reference line 40—40 extending at right angles to the screw 30 and between the socket centers. By reversing and flipping over the confronting members 12*a*–12*a*' and/or 12*b*–12*b*', the socket entryways involved will open onto a quadrant above the reference line 40—40 so that the panels involved are adjustable in these quadrants. FIG. 7 shows the right hand confronting member 12*b* and 12*a* reversed in position from that shown in FIG. 6 so that the right hand panel 6 can be adjusted in position in a quadrant above the reference line 40—40. FIGS. 6 and 7 show in dash lines the extremes of position of the panels 6 and 6 by varying the positions of the insert members 8 and 8 in the sockets 18 and 18' of the clamping devices 4 thereshown.

Figure 8:
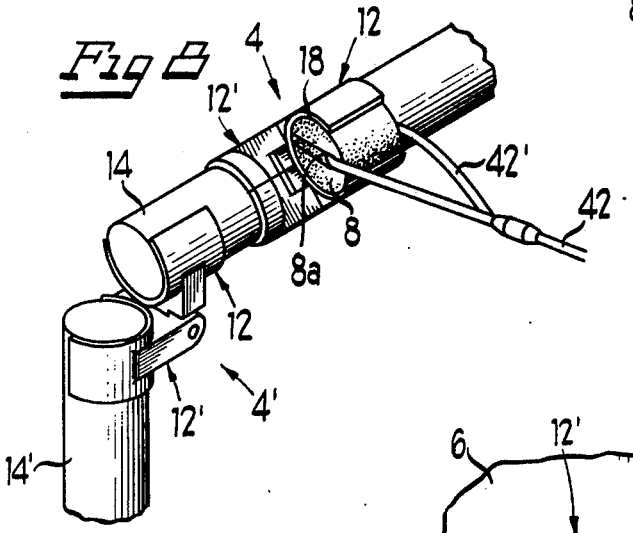
FIG. 8 illustrates an application of the clamping device of the present invention when it is used as a tension adjusting device for a support cable.

FIG. 8 shows a clamping device 4' with socket-forming sections 12 and 12' locked into positions where they extend at right angles to one another and receive the end portions of poles 14–14', and a clamping device 4 where the socket-forming sections 12 and 12' are clamped respectively around the pole 14 and a panel edge-receiving insert member 8 rotated into a position where its slot 8*a* is opposite a closed portion of the associated socket 18. An eyelet 42' of a steel cable 42 or the like is threaded through the slot 8*a* of the insert member 8. The tension on the cable 42 is adjusted by varying the angle between the socket-forming sections 12 and 12' of the clamping device 4.

Figure 9:
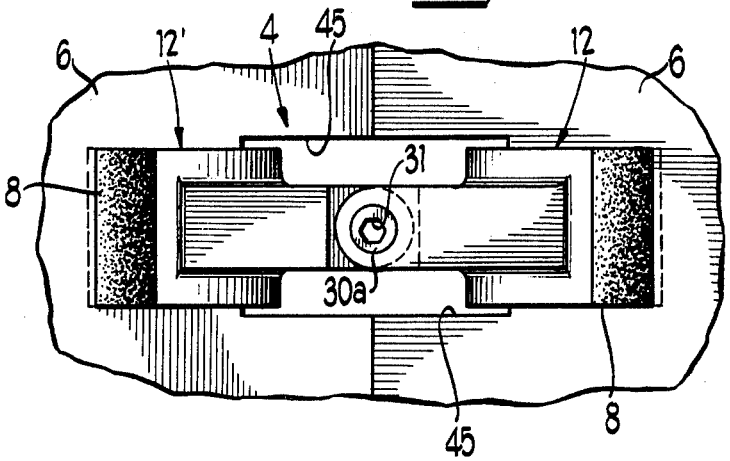
FIG. 9 illustrates a clamping device of the invention interconnecting a pair of vertical panels which are in abutment.

FIG. 9 shows an application of a clamping device 4 wherein the socket-forming sections 12 and 12' thereof are positioned in the same plane and wherein the associated sockets 18 and 18' receive panel edge-receiving insert members 8 and 8 into which abutting panels 6 and 6 extend. The panel abutment is made possible because the panels are provided with slots 45—45 which permits the insertion of the exposed edges of these slots into the slots of the panel edge-receiving insert members 8 and 8 while the outermost confronting edges of these panels are in abutment.

It is apparent that the clamping devices of the invention have a wide variety of uses not possible with the clamping devices of the prior art and are very easy to adjust and to lock in any of their adjusted positions so that a display structure can be quickly assembled or dis-assembled with a minimum of effort and in a minimum of time.

It should be understood that numerous modifications may be made in the most preferred forms of the invention described without deviating from the broader aspects of the invention. For example, while it is preferred that the socket-forming sections of the clamping device 4 have a common hinge axis formed by a pivot-forming and clamping means formed by a screw or the like, in accordance with the broader aspects of the invention the socket-forming sections of the device could be constructed with separate pivot axes which, however, would require more parts and a higher cost of manufacture.

I claim:

1. A clamping device comprising, in combination, a pair of socket-forming assemblies each mounted for independent pivotable movement relative to the other about a given pivot axis, each of said socket-forming assemblies comprising a pair of confronting members having confronting surfaces forming a socket, the longitudinal axes of the sockets of said confronting members being perpendicular to the pivot axis of each socket-forming assembly so that the angular position of said socket-forming assemblies can be adjusted to various positions between those where said socket axes are parallel and where they are generally perpendicular to one another, the socket-forming surface of one of the members of each of said pairs of confronting members providing a socket-forming surface extending over a greater arc than that of the other member and terminating at points which provide a socket entryway occupying an appreciable portion of a quadrant and which is asymmetrically related to a reference line extending transversely of its pivot axis, said pair of members of each socket-forming assembly being reversible in position in the clamping device so that the socket entryways of the two socket-forming assemblies can be asymmetrically related to said reference line on either side thereof, each of said pairs of confronting members forming a clamp and being mounted for relative movement wherein the confronting socket-forming surfaces thereof are progressively movable toward one another to clamp around an elongated member or slotted panel-receiving insert member when placed in the socket formed therebetween, and clamp-forming means for forcing each of said pair of members toward each other to tighten the same around an insert member or elongated member placed within the socket thereof.

2. The clamping device of claim 1 combined with at least one resilient compressible insert member inserted into a socket of one of said assemblies, said insert member having a slot which opens onto said socket and when oriented to open onto said socket entryway can receive a panel inserted through the socket entryway.

3. The clamping device of claim 2 wherein the edge portion of a panel extends into said panel-receiving slot and is clamped between the defining walls thereof by the force supplied by said clamp-forming means, and an elongated structural member extending into the socket formed by the other pair of confronting members and clamped thereby by the clamping force supplied by said clamp-forming means.

4. The clamping device of claim 2 wherein said insert member has an orientation within the associated socket so the slot therein is opposite a closed portion of said socket.

5. The clamping device of claim 4 wherein an eyelet made of a flexible material threads through said closed slot of said insert member.

6. The clamping device of claim 5 wherein the socket formed by the other of said assemblies has an elongated structural member clamped therein, said eyelet extending to means for supporting the elongated structural member in an upright position, the tension on said eyelet being variable by varying the angle formed between the axes of said sockets.

7. The clamping device of claim 2 wherein the sockets of each of said socket-forming assemblies has said slotted insert member, said confronting socket-forming surfaces of said assemblies are cylindrical surfaces, each of said insert members have a cylindrical surface to enable the same to be progressively rotatable into different positions within the associated socket to enable the progressive variance of the angular relationship of a panel extending into the insert member slot of one of the assemblies relative to a panel extending into the slotted insert member in the other socket-forming assembly.

8. A clamping device comprising, in combination, a pair of socket-forming assemblies hinged for pivotal movement about a common hinge axis, each of said socket-forming assemblies comprising a pair of confronting members having confronting surfaces forming a pass-through socket, the longitudinal axes of said sockets being generally perpendicular to said hinge axis and over the adjusted position of said socket-forming assemblies about said hinge axis assuming various positions between those where said longitudinal socket axes are parallel and where they are generally perpendicular to one another, each of said pair of confronting members of each socket-forming assembly having a portion in axial alignment with the other of same and also with portions of the other pair of confronting members, which aligned portions are hinged together to pivot about said common hinge axis, said aligned portions of said pair of confronting members constituting a sandwich of such portions which can be clamped together with a drawing force applied to the outermost of said aligned portions and lockable clamping means for drawing said aligned portions of said confronting clamping members toward one another, simultaneously to draw each of said pair of confronting members into clamping engagement with an elongated member or insert member placed in the socket therebetween, and to lock said socket-forming assemblies into an adjusted pivoted position.

9. The clamping device of claim 8 wherein said lockable clamping means is formed, in part, by said pivot-forming member which is a screw having a head portion at one end thereof bearing against a shoulder of one of the outermost of said aligned portions, a threaded portion at the opposite end thereof threading into a portion of the other of said outermost portions of said aligned portions of the confronting members, and said threaded portion of the screw means being a self-locking screw means which, when said aligned portions of said confronting members are tightly clamped, the screw means locks itself in place to avoid loosening thereof by other than a manually applied twisting force applied to said head portion of said screw.

10. The clamping device of claim 8 wherein said aligned portions of said confronting members of one of said socket-forming assemblies are between the aligned portion of said confronting member of the other socket-forming assembly.

11. The clamping device of claim 8 wherein the socket-forming surface of one of the members of each of said pairs of confronting members provides a socket-forming surface extending over a greater arc than that of the other member and terminates at points which provide a socket entryway which is asymmetrically related to a reference line extending transversely of its pivot axis, said pair of members of each socket-forming assembly being reversible in position in the clamping device so that the socket entryways of the two socket-forming assemblies can be asymmetrically related to said reference line on either side thereof.

12. The clamping device of claim 11 combined with at least one resilient compressible insert member inserted into a socket of one of said assemblies, said insert member having a slot which opens onto said socket and when oriented to open onto said socket entryway, it can receive a panel inserted through the socket entryway.

13. The clamping device of claim 8 wherein said lockable clamping means also forms the hinge for said socket-forming assemblies.

* * * * *